US005813741A

United States Patent [19]

Fish et al.

[11] Patent Number: 5,813,741

[45] Date of Patent: Sep. 29, 1998

[54] ADJUSTABLE SHELF FOR A REFRIGERATOR

[75] Inventors: Edison Allen Fish; Thomas R. Swindell, both of Greenville, Mich.; Randall Sandlin, Columbus; Russell George Patterson, III, Dublin, both of Ohio; Daniel James Ocharzak; Robert Henry Martin, both of Columbus, Ohio

[73] Assignee: White Consolidated Industries, Inc., Cleveland, Ohio

[21] Appl. No.: 590,137

[22] Filed: Jan. 23, 1996

[51] Int. Cl.[6] ..... A47B 96/04

[52] U.S. Cl. ..... 312/408; 312/351; 211/153; 108/108

[58] Field of Search ..... 312/236, 246, 312/298, 300, 302, 311, 351, 401, 404, 408, 410; 211/153, 151, 90, 99, 170; 108/107, 108; 248/235, 243

[56] References Cited

U.S. PATENT DOCUMENTS

| | | | |
|---|---|---|---|
| D. 309,461 | 7/1990 | Bussan et al. | D15/89 |
| 2,091,607 | 8/1937 | Nave | 211/153 |
| 2,092,430 | 9/1937 | Stratton | 312/298 |
| 2,287,611 | 6/1942 | Harbison . | |
| 2,319,470 | 5/1943 | Nobles | 211/153 |
| 2,352,345 | 6/1944 | Rundell | 211/153 |
| 2,564,478 | 8/1951 | Harbison | 211/153 |
| 2,976,101 | 3/1961 | Rooney | 312/300 X |
| 3,185,315 | 5/1965 | Andreassen | 211/153 X |
| 3,311,072 | 3/1967 | Pattison | 312/351 |
| 3,334,954 | 8/1967 | Kesling | 312/351 |
| 3,565,504 | 2/1971 | Brown | 312/351 X |
| 3,586,411 | 6/1971 | Brigham | 312/351 |
| 3,625,371 | 12/1971 | Dill | 211/153 |
| 3,690,744 | 9/1972 | Squire | 312/351 X |
| 3,859,932 | 1/1975 | Armstrong et al. | 108/75 |
| 3,912,085 | 10/1975 | Cooke et al. | 211/153 |
| 3,981,552 | 9/1976 | Karashima . | |
| 3,984,163 | 10/1976 | Boorman, Jr. et al. | 312/408 |
| 4,437,572 | 3/1984 | Hoffman | 211/153 |
| 4,462,645 | 7/1984 | Ballarin et al. | 312/326 |
| 4,528,825 | 7/1985 | Khan | 312/313 |
| 4,735,470 | 4/1988 | Falk | 312/246 |
| 4,736,997 | 4/1988 | Besore et al. | 312/236 |
| 4,815,685 | 3/1989 | Roberts et al. . | |
| 4,923,260 | 5/1990 | Poulsen | 312/408 |
| 4,934,541 | 6/1990 | Bussan et al. | 211/153 |
| 4,944,566 | 7/1990 | Carper | 312/311 |
| 4,960,308 | 10/1990 | Donaghy | 248/235 X |
| 5,022,539 | 6/1991 | Rushing et al. | 108/108 X |
| 5,199,778 | 4/1993 | Aoki et al. | 312/408 |
| 5,226,707 | 7/1993 | Han et al. | 312/298 X |
| 5,273,354 | 12/1993 | Herrmann et al. | 312/408 |

(List continued on next page.)

FOREIGN PATENT DOCUMENTS

| | | | |
|---|---|---|---|
| 363868 | 4/1990 | European Pat. Off. | 312/246 |
| 8201916 | 12/1983 | Netherlands | 211/153 |
| 934745 | 8/1963 | United Kingdom | 211/153 |

*Primary Examiner*—Peter M. Cuomo
*Assistant Examiner*—James O. Hansen
*Attorney, Agent, or Firm*—Pearne, Gordon, McCoy & Granger LLP

[57] ABSTRACT

The present invention is directed toward a shelf support assembly having a pair of lateral support brackets removably mounted in a refrigerator, a support member interconnecting the lateral support brackets, and a central support bracket attached to the support member. A cross brace interconnects the central support bracket with one of the lateral support brackets. The central support bracket, cross brace, and lateral support brackets cooperate to define a support frame which slidingly supports a slidable shelf and pivotally supports a pivotable shelf. The sliding shelf includes stops to limit movement thereof. The pivotable shelf can be pivotally moved between a horizontal deployed position and first and second angled storage positions. The pivotable shelf includes detents which engage the support frame and releasably retain the pivotable shelf in one of the angled storage positions.

36 Claims, 5 Drawing Sheets

U.S. PATENT DOCUMENTS

| | | | |
|---|---|---|---|
| 5,299,863 | 4/1994 | Albright, Jr. | 312/404 |
| 5,332,611 | 7/1994 | Shanok et al. | 108/27 |
| 5,340,209 | 8/1994 | Kolbe et al. | 312/408 |
| 5,362,145 | 11/1994 | Bird et al. | 312/408 |
| 5,403,083 | 4/1995 | Dasher et al. | 312/408 |
| 5,403,084 | 4/1995 | Kane et al. | 312/408 |
| 5,406,894 | 4/1995 | Herrmann et al. | 108/108 |
| 5,429,433 | 7/1995 | Bird et al. | 312/408 |
| 5,441,338 | 8/1995 | Kane et al. | 312/408 |
| 5,454,638 | 10/1995 | Bird et al. | 312/408 |
| 5,577,823 | 11/1996 | Maglinger | 312/408 X |

138
54
126
52
140
144
148
100
56
46
129
136

60
32
58
54
80a
70
5
5
6
6
68
69
104
69
68
118
70
119
118
66
118
119
106
48
44
108
116

69
152
71
66
64
48
104
106
150
118

152
71
66
64
48
104
106
150
118

104
152
118
64
119
150
106
71
118
66
119
48

104
118
119
66
106
71
118
119
48

ADJUSTABLE SHELF FOR A REFRIGERATOR

BACKGROUND OF THE INVENTION

It has been recognized that conventional type shelving arrangements in household refrigerators will not accommodate tall or over-sized articles that are to be stored in a refrigerator or freezer cabinet. Typically, a plurality of stationary shelves are housed in a refrigerator cabinet. In an effort to make the interior space of the refrigerator cabinet more accommodating, removable and reconfigurable shelves have become more popular. A number of approaches have been taken to maximize the usable space within a refrigerator cabinet.

One approach has been to provide a shelf that extends only partially across the width of the refrigerator cabinet. This shelf construction is designed to be laterally and vertically moved to different locations within the refrigerator cabinet. Examples of this approach are illustrated in U.S. Pat. Nos. 5,454,638 and 5,403,084, both of which are expressly incorporated herein by reference in their entireties.

A similar approach is to arrange the shelving units in such way that permits facile vertical movement or removal of the entire shelving unit. See, for example, U.S. Pat. No. 3,859,932 wherein the front portion of the shelf is movable and may be slid under the shelf in the back portion of the refrigerator cabinet when not in use.

Yet another approach is to allow horizontal or lateral movement of the shelf. This is accomplished by extending the shelf only partially across the width of the refrigerator cabinet, and using a shelf bracket or mounting unit which is designed to slidingly engage the shelving unit. As an example, U.S. Pat. No. 5,403,083, which is expressly incorporated herein by reference in its entirety, discloses a shelving unit which can be laterally adjusted along the back wall of the refrigerator cabinet. It illustrates the use of three standards or mounting rails attached to the back wall of the refrigerator cabinet, and a shelf mounting bracket extending across the width of the refrigerator cabinet. The mounting bracket has a continuous channel designed to slidingly receive the shelf. This type of shelf suffers from the disadvantage that it requires three mounting rails, and is limited to lateral movement.

There exists a need in the art for a refrigerator shelf support assembly which can accommodate shelves that are adjustable in both a horizontal and vertical direction. There also exists a need for a support assembly which can be mounted within a refrigerator having a pair of conventional mounting rails.

SUMMARY OF THE INVENTION

In accordance with the present invention, a refrigerator shelf support assembly includes a support frame having first and second mounting rails, first and second lateral support brackets removably mounted to the mounting rails, a support member interconnecting the lateral support brackets, and a central support bracket attached to the support member between the lateral support brackets and extending outwardly from the support member. The shelf assembly also includes a cross brace extending between the central support bracket and the second lateral support bracket.

In further accordance with the present invention, the second lateral support bracket cooperates with the central support bracket to support a sliding shelf. The sliding shelf includes a stop which engages one of the support brackets or the cross brace to limit movement of the sliding shelf.

In further accordance with the present invention, the first lateral support bracket includes an axle which receives and supports a pivotable shelf. The pivotable shelf includes hinge members which pivotally engage the axle, and detent members which engage the first lateral support bracket and are operable to support the pivotable shelf at an angle. The pivotable shelf also includes a spacer which engages the central support bracket and maintains the spacing between the pivotable and slidable shelves. The central support bracket includes laterally extending tabs which support the pivotable shelf when in a horizontal deployed position.

BRIEF DESCRIPTION OF THE DRAWINGS

These and further features of the present invention will be apparent from the following description and drawings, wherein.

DETAILED DESCRIPTION OF THE PREFERRED EMBODIMENT

Figure 1:
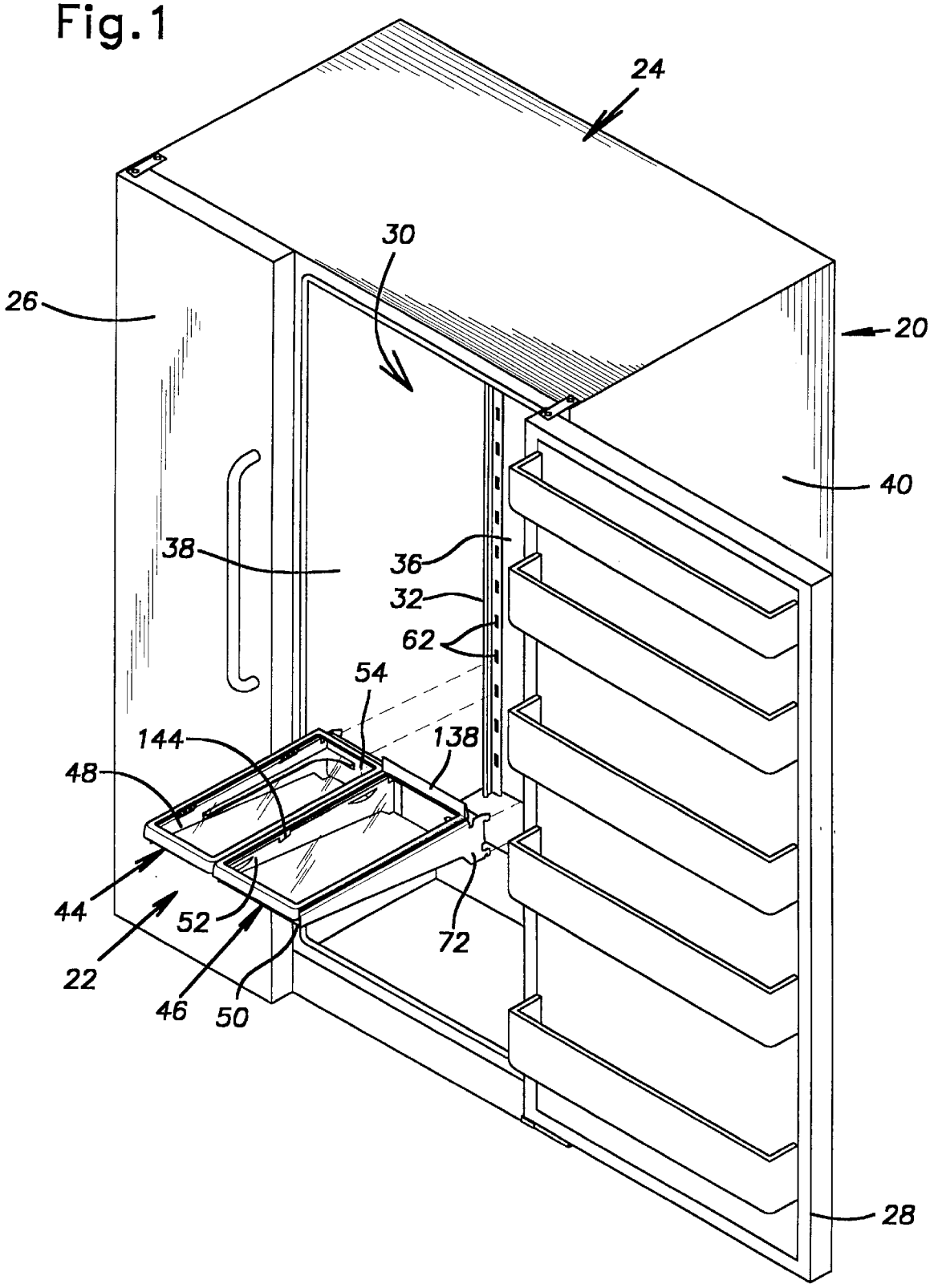
FIG. 1 is an exploded perspective view of a household side-by-side refrigerator and a shelf assembly according to the present invention.

With reference to FIG. 1, a household side-by-side refrigerator 20 incorporating a shelf assembly 22 according to the present invention is illustrated. The refrigerator 20 includes a plurality of walls defining an insulated cabinet 24 to which a freezer door 26 and a refrigerator door 28 are pivotally mounted. The doors 26, 28 cooperate with the cabinet 24 to define a freezer compartment (not shown) and a refrigeration compartment 30.

First and second shelf ladders or mounting rails 32, 34 (FIG. 2) are attached to a rear wall 36 of the refrigerator cabinet 24 and are disposed within the refrigeration compartment 30. Naturally, an additional pair of mounting rails may be similarly attached to the cabinet rear wall 36 and disposed within the freezer compartment. For convenience, the shelf assembly 22 according to the present invention will be described hereinafter as being mounted within the refrigeration compartment 30, the description being equally applicable to mounting of the shelf assembly 22 within the freezer compartment.

The mounting rails 32, 34 are spaced a predetermined distance apart, the first mounting rail 32 being preferably located adjacent a center wall 38 of the refrigerator cabinet 24, and the second mounting rail 34 being preferably located adjacent a lateral side wall 40 of the refrigerator cabinet 24. The mounting rails 32, 34 accommodate a plurality of supporting assemblies in addition to one or more shelf assemblies 22 according to the present invention, and each of the respective assemblies are positioned to permit adequate room for the intended food storage function of the respective assemblies, as well as convenient access by the user.

Figure 8:
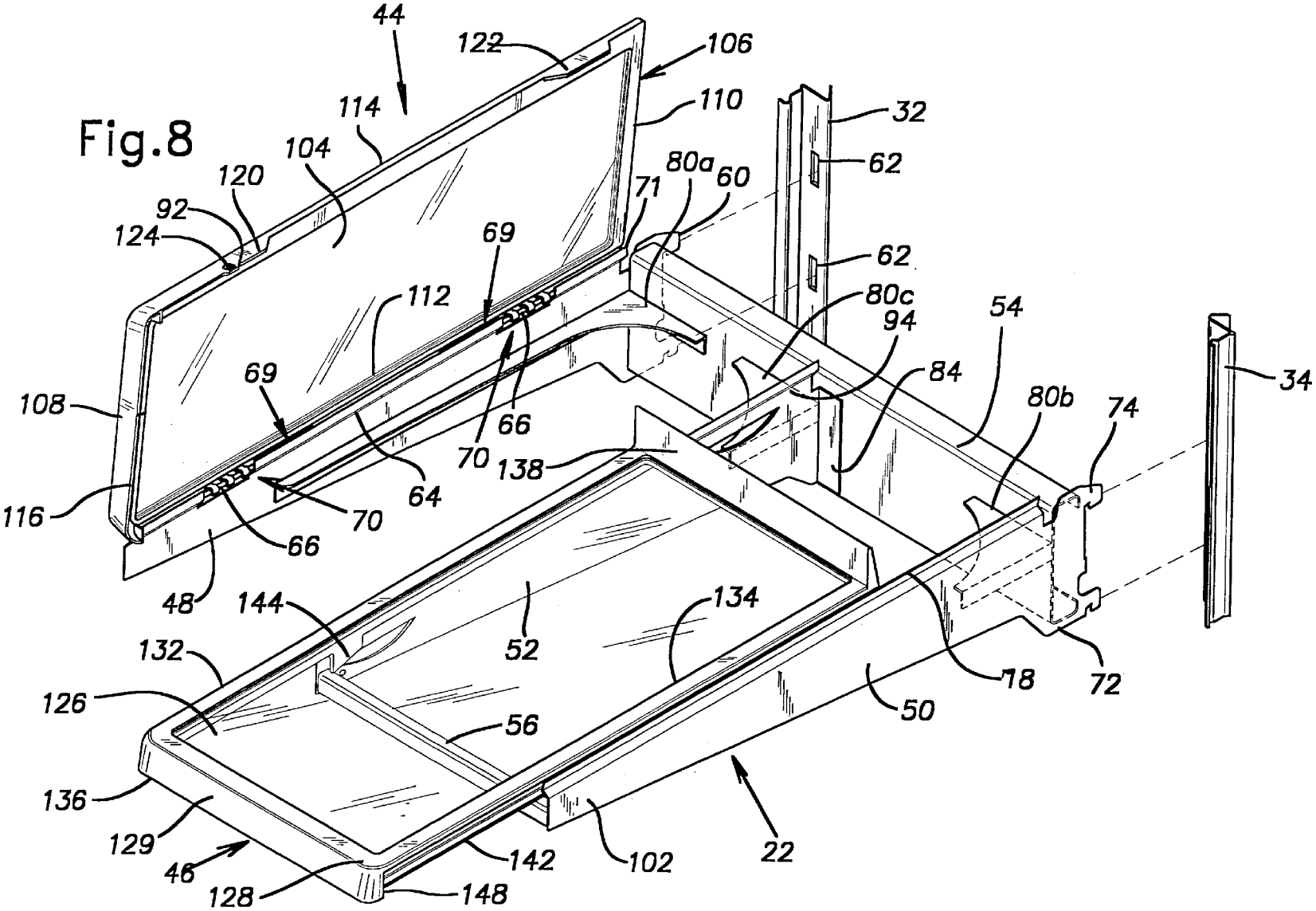
FIG. 8 is perspective view of the shelf assembly shown in FIG. 1, with the first shelf in the second angled storage position and the second shelf in an extended position; and, FIG. 9 is a top plan view of a shelf support frame according to the present invention.
Figure 9:
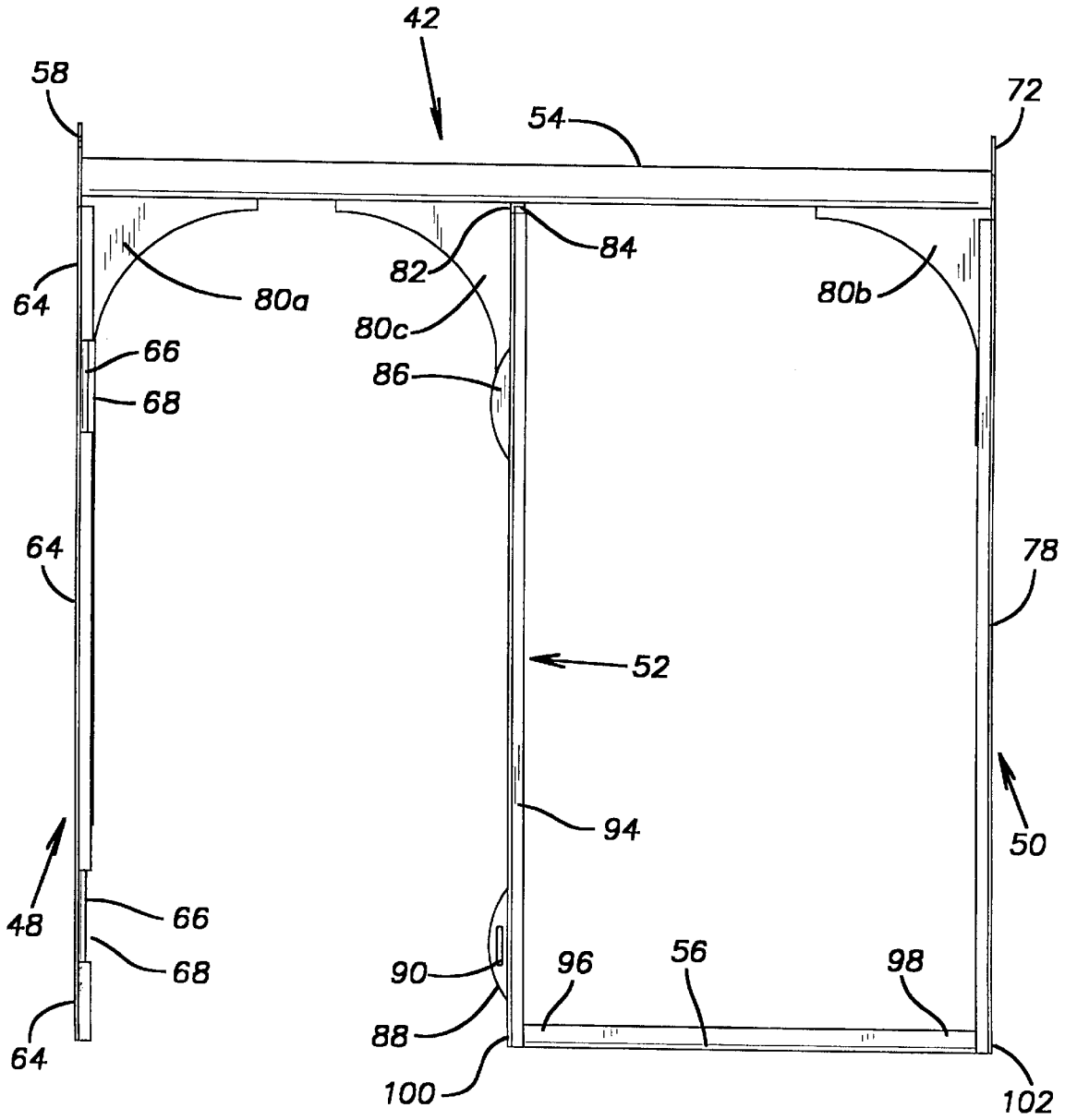

The shelf assembly 22 is shown best in FIG. 8, and includes a support frame 42 (FIG. 9), a first or pivotable, flip-up shelf 44, and a second or slidable shelf 46.

The support frame 42 includes first and second lateral support brackets 48, 50, a central support bracket 52, a support member 54, and a cross brace 56.

The first lateral support bracket 48 has an elongated body with an outer side facing the cabinet center wall 38 and an opposing inner side facing the central support bracket 52. The first lateral support bracket 48 is preferably formed or stamped from a unitary piece of painted sheet metal, and has a proximal end 58 removably secured to the first mounting rail 32.

The proximal end 58 includes a pair of vertically aligned hooks 60 that extend through spaced-apart apertures 62 in the first mounting rail 32 to removably secure the proximal end 58 to the first mounting rail 32. Preferably, the first lateral support bracket 48 extends away from the first mounting rail 32 in an unsupported or cantilever fashion, as illustrated.

Extending along the top of the first lateral support bracket 48 is a V-shaped projection 64 that is separated into three discontinuous sections by a pair of notched openings 68 (FIGS. 4–8). The V-shaped projection 64 opens laterally on the outer side of the first lateral support bracket 48. An elongated rod or axle 66 is integrally attached to the interior of the V-shaped projection 64 on the outer side of the first lateral support bracket 48. The first shelf 44 includes hinge members 70 that extend through the notched openings 68 and are pivotally secured to the rod 66. The first shelf also includes detent members 69 that engage an upper surface or edge 71 of the first lateral support bracket 48, as will be described more fully hereinafter.

The second lateral support bracket 50 has an elongated body with an outer side facing the cabinet lateral side wall 40 and an opposing inner side facing the central support bracket 52. The second lateral support bracket 50 is preferably formed or stamped from a unitary piece of painted sheet metal and has a proximal end 72 and a distal end 102. The proximal end 72 is removably secured to the second mounting rail 34, and the second lateral support bracket 50 extends outwardly from the second mounting rail 34 in a direction generally parallel to the first lateral support bracket 48.

The proximal end 72 includes a pair of vertically aligned hooks 74 that extend through spaced-apart apertures (not shown) in the second mounting rail 34 to removably secure the proximal end 72 to the second mounting rail 34. Preferably, the second lateral support bracket 50 extends outwardly from the second mounting rail 34 in an unsupported or cantilever fashion, as illustrated.

Extending along the top of the second lateral support bracket 50 is a V-shaped projection 78 that opens laterally on the outer side of the second lateral support bracket 50. The V-shaped projection 78 cooperates with a like structure extending from the central support bracket 52, and mating structures on the second shelf 46, to slidably receive and support the second shelf 46, as will be discussed more fully hereinafter. The V-shaped projection 78 is generally a mirror-image of the V-shaped projection 64 described hereinbefore and illustrated in FIGS. 5–7*b*, but is continuous (i.e., is not interrupted by notched openings).

The support member 54 is generally C-shaped in cross section, is formed or stamped from a piece of painted sheet metal, and extends between and interconnects the proximal ends 58, 72 of the first and second lateral support brackets 48, 50, as illustrated. The support member 54 is rigidly attached to each of the lateral support brackets 48, 50 by welds or equivalent mechanical connection means. Gussets 80*a*, 80*b* are welded to the support member 54 and the lateral support brackets 48, 50 to increase the rigidity and strength of the resulting support frame 42. The gusset 80*a* connecting the first lateral support bracket 48 and the support member 54 is relatively elongated, and extends along the length of the first lateral support bracket 48 a distance, as illustrated.

The central support bracket 52 has a proximal end 82 and a distal end 100. The proximal end 82 has a laterally bent flange 84 that is attached by welding or equivalent mechanical means to the support member 54. The central support bracket 52 is attached to the support member 54 intermediate the first and second lateral support brackets 48, 50, and extends outwardly away from the support member 54 in a direction generally parallel to the lateral support brackets 48, 50, as illustrated. A gusset 80*c*, which is generally identical to the gusset 80*b*, is attached to the central support bracket 52 and the support member 54 on a side of the central support bracket 52 facing the first lateral support bracket 48, as illustrated. Preferably, the central support bracket 52 extends away from the support member 54 in an unsupported or cantilever fashion.

The central support bracket 52 has an elongated body from which first and second tabs 86, 88 extend laterally toward the first lateral support bracket 48. Upper surfaces of the tabs 86, 88 define a generally horizontal plane and, the tabs 86, 88 serve to vertically support the first shelf 44 in a generally horizontal position. The second tab 88 has a slotted opening 90 formed therein which receives a finger 92 (FIG. 8) that extends downwardly from the first shelf 44.

The central support bracket 52 also has, at an upper portion thereof, an elongated, generally V-shaped projection 94 laterally extending therefrom toward the second lateral support bracket 50. The central support bracket's V-shaped projection 94 is generally parallel to the second lateral support bracket's V-shaped projection 78, and the projections 94, 78 define a sliding support surface for the second shelf 46. The V-shaped projection 94 is generally identical to the V-shaped projection 64 (but without the notched openings), and is generally a mirror-image of the V-shaped projection 78.

The cross brace 56 has a generally L-shaped cross section, and includes a first end 96 attached to the central support bracket 52 and a second or opposite end 98 attached to the second lateral support bracket 50. The cross brace 56 is preferably attached by spot welding, but may be secured by various other mechanical means, such as a snap-lock mechanical connection. The cross brace adds support and rigidity to the support frame 42, and stiffens or locates the distal ends 100, 102 of the central support bracket 52 and the second lateral support bracket 50 to maintain proper alignment and spacing between the central support bracket 52 and the second lateral support bracket 50 and thereby permit sliding movement and retention of the second shelf 46.

The first shelf 44 includes a shelf plate 104, preferably formed of glass or clear plastic, and a thermoplastic rim 106 molded over the peripheral edge of the shelf plate 104. The rim 106 encases the shelf plate 104 and forms a peripheral barrier to prevent any liquids spilled onto the shelf plate 104 from flowing off the shelf plate and onto foodstuffs therebelow.

The rim 106 has a front side 108, a rear side 110, and first and second lateral sides 112, 114. The front side 108 provides a downwardly extending handle portion 116 which the user may grasp to pivotally move the first shelf 44 between a horizontal, deployed position (FIGS. 1, 2), a first angled storage position (FIG. 7*a*), and a second angled storage position (FIGS. 7*b*, 8).

The first lateral side 112 of the first shelf 44 includes the hinge members 70 and the detent members 69. The hinge members 70 are defined by a plurality of semi-cylindrical projections 118 (three in the illustrated embodiment). As shown best in FIGS. 4–7, each of the projections 118 include a pair of arcuate arms having terminal free edges 119 spaced apart a short distance from one another. When the first shelf 44 is pivotally mounted to the first lateral support bracket 48, the rod 66 is inserted or pushed between the terminal edges 119, the arms resiliently or elastically deform in a radial direction, and thereafter snap-back to their original position to receive and retain the rod 66.

Figures 3, 4, 5, 6, 7A, 7B:
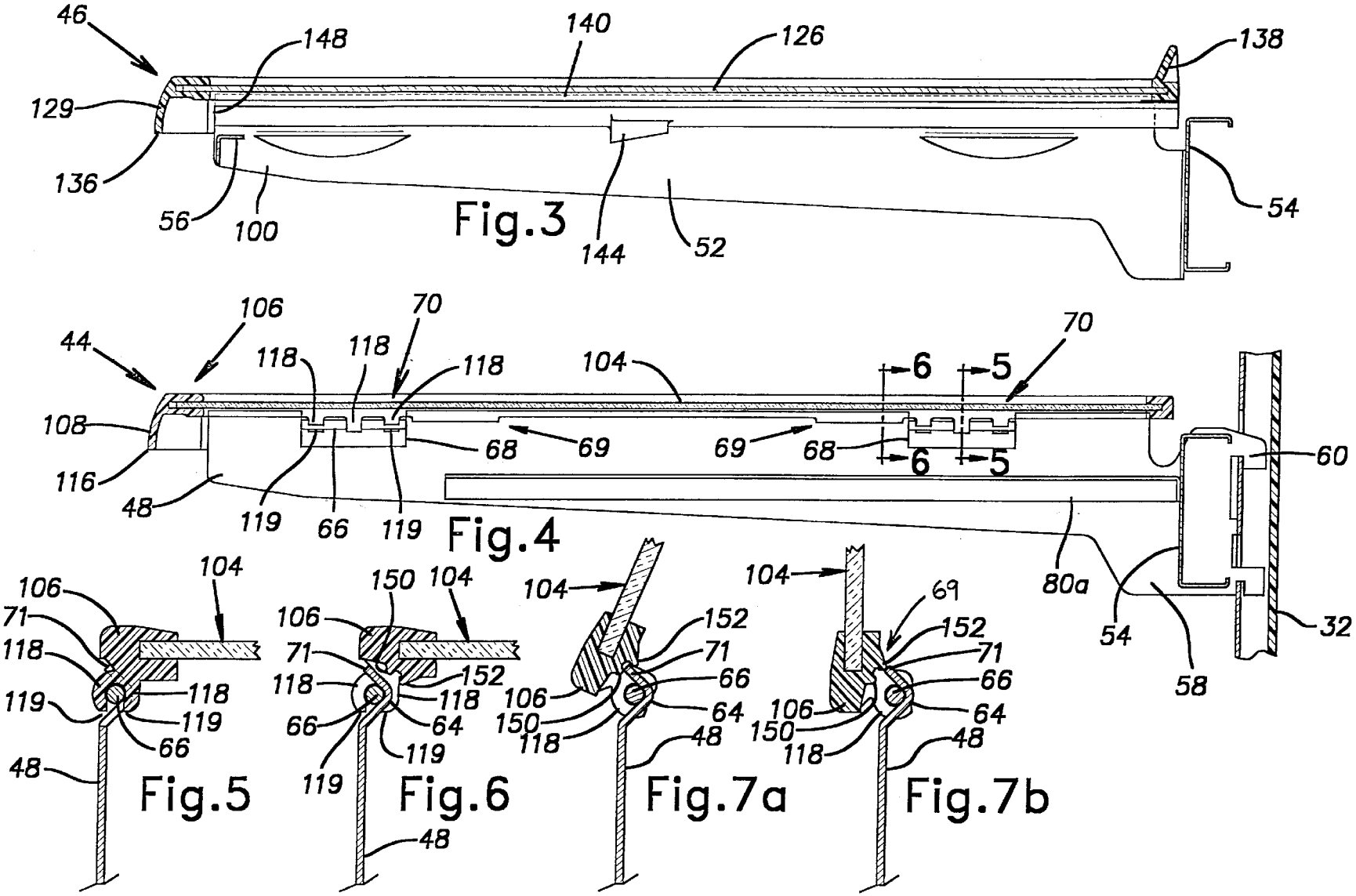
FIG. 3 is a cross-sectional view of a portion of the shelf assembly including a second or slidable shelf, as seen along line 3—3 of FIG. 2.
FIG. 4 is a cross-sectional view of another portion of the shelf assembly including a first or pivotable shelf, as seen along line 4—4 of FIG. 2.
FIG. 5 is a cross-sectional view of the other portion of the shelf assembly including the first shelf, as seen along line 5—5 of FIG. 4.
FIG. 6 is a cross-sectional view of the other portion of the shelf assembly including the first shelf, as seen along line 6—6 of FIG. 4, with the first shelf in a horizontal, deployed position.
FIG. 7*a* is a cross-sectional view similar to FIG. 6, but with the first shelf in a first angled storage position.
FIG. 7*b* is a cross-sectional view similar to FIGS. 6 and 7*a*, but with the first shelf in a second angled storage position.

The detent members 69, as shown best in FIGS. 7*a* and 7*b*, include first and second protruding ribs or detents 150, 152. Rotation of the first shelf 44 about the axis defined by the axle or rod 66 from the horizontal or deployed position (FIG. 6) to the first angled storage position (FIG. 7*a*) causes the first detent or rib 150 to snap over the upper edge 71 of the first lateral support bracket 48. Engagement between the first rib or detent 150 and the upper edge 71 of the first lateral support bracket 48 maintains the first shelf 44 in the first angled storage position (FIG. 7*a*) and prevents the first shelf 44 from unintentionally or inadvertently rotating back to the horizontal deployed position (FIG. 6). Similarly, as the first shelf 44 is further rotated about the axle 66 from the first angled storage position (FIG. 7*a*) to the second angled storage position (FIG. 7*b*) the second detent 152 engages the first lateral support bracket 48 and snaps over the upper edge 71 of the first lateral support bracket 48. Engagement between the second detent or rib 152 and the upper edge 71 maintains the first shelf 44 in the second angled storage position (FIG. 7*b*) and prevents the first shelf 44 from unintentionally or inadvertently rotating back toward the first angled storage position or the horizontal deployed position. A small user-applied force will easily overcome the detents or ribs 150, 152, and snap the detents 150, 152 back over the upper edge 71 of the first lateral support bracket 48 the first shelf 44 to rotate from the first and/or second angled position (FIGS. 7*a*, 7*b*) back to the deployed position (FIG. 6).

Preferably, the first angled storage position shown in FIG. 7*a* is about 67° relative to horizontal and the second angled storage position shown in FIG. 7*b* is about 90° relative to horizontal.

The second lateral side 114 of the first shelf 44 includes front and rear tabs 120, 122 and a spacer member 124. The front and rear tabs 120, 122 extend downwardly from the second lateral side 114 and rest upon the lateral tabs 86, 88 of the central support bracket 52 when the first shelf 44 is in the deployed or horizontal position. The front tab 120 includes the finger 92 that extends through the slotted opening 90 in the central support bracket's second tab 88, as briefly mentioned hereinbefore. The spacer member 124 extends laterally or outwardly from the second lateral side 114 generally perpendicular to the front and rear tabs 120, 122, and has a gently curved outer surface which engages the central support bracket 52. The spacer member 124 is provided near the front tab 120, and engages the central support bracket 52 when the first shelf is in the horizontal deployed position and serves to maintain the first shelf spaced laterally a short distance from the second shelf, and helps to locate or align the finger 92 with the slotted opening 90.

Insertion of the finger 92 into the slotted opening 90 prevents or limits relatively forward or backward movement of the first shelf 44 when in the deployed position, and prevents or limits twisting of the first shelf 44 about the hinge members 70, which might damage the hinge members 70 or cause the rod 66 to escape from the hinge members 70.

Therefore, when the first shelf 44 is in the deployed position, it is vertically supported by the first lateral support bracket 48 (via the rod 66 and the hinge members 70) and the central support bracket 52 via the tabs 86, 88. When in the vertical or storage position, the first shelf 44 is supported by the first lateral support bracket 48 via the rod 66 and the hinge members 70.

The second shelf 46 includes a shelf plate 126, preferably formed of glass or clear plastic, and a thermoplastic rim 128 molded over the peripheral edge of the shelf plate 126. The rim 128 encases the shelf plate 126 and forms a peripheral barrier to prevent any liquids spilled onto the shelf plate from flowing off the shelf plate and onto foodstuffs therebelow.

The second shelf's rim 126 has a front side 129, a rear side 130, and first and second lateral sides 132, 134. The front side 129 provides a downwardly extending handle portion 136 which the user may grasp to slidably move the second shelf 46 forwardly and backwardly between extended and retracted positions. The rear side 130 has an upwardly extending portion 138 that serves as a barrier to help prevent articles on the second shelf 46 from falling thereoff as the shelf is slidably moved between the extended and retracted positions.

The first and second lateral sides 132, 134 of the second shelf's rim 126 each have a lateral, V-shaped groove 140, 142 formed therein, and a downwardly projecting stop 144 (one shown). The first side's groove 140 matingly receives the central support bracket's V-shaped projection 94. The second side's groove 142 matingly receives the second lateral support bracket's V-shaped projection 78. The second shelf 46 is slidably supported by the cooperation of the grooves 140, 142 and the projections 94, 78. The first and second lateral side's stops 144 engage the cross brace 56 to limit sliding movement of the second shelf 46, and define the "fully extended" position of the second shelf 46 (FIG. 8). Preferably, each of the stops 144 has a vertical front surface which engages the cross brace 56 and an angled or sloping rear surface. The angling of the stops' rear surface facilitates insertion loading or insertion of the second shelf 46 in the support frame, as will be apparent from the discussion to follow.

Figure 2:
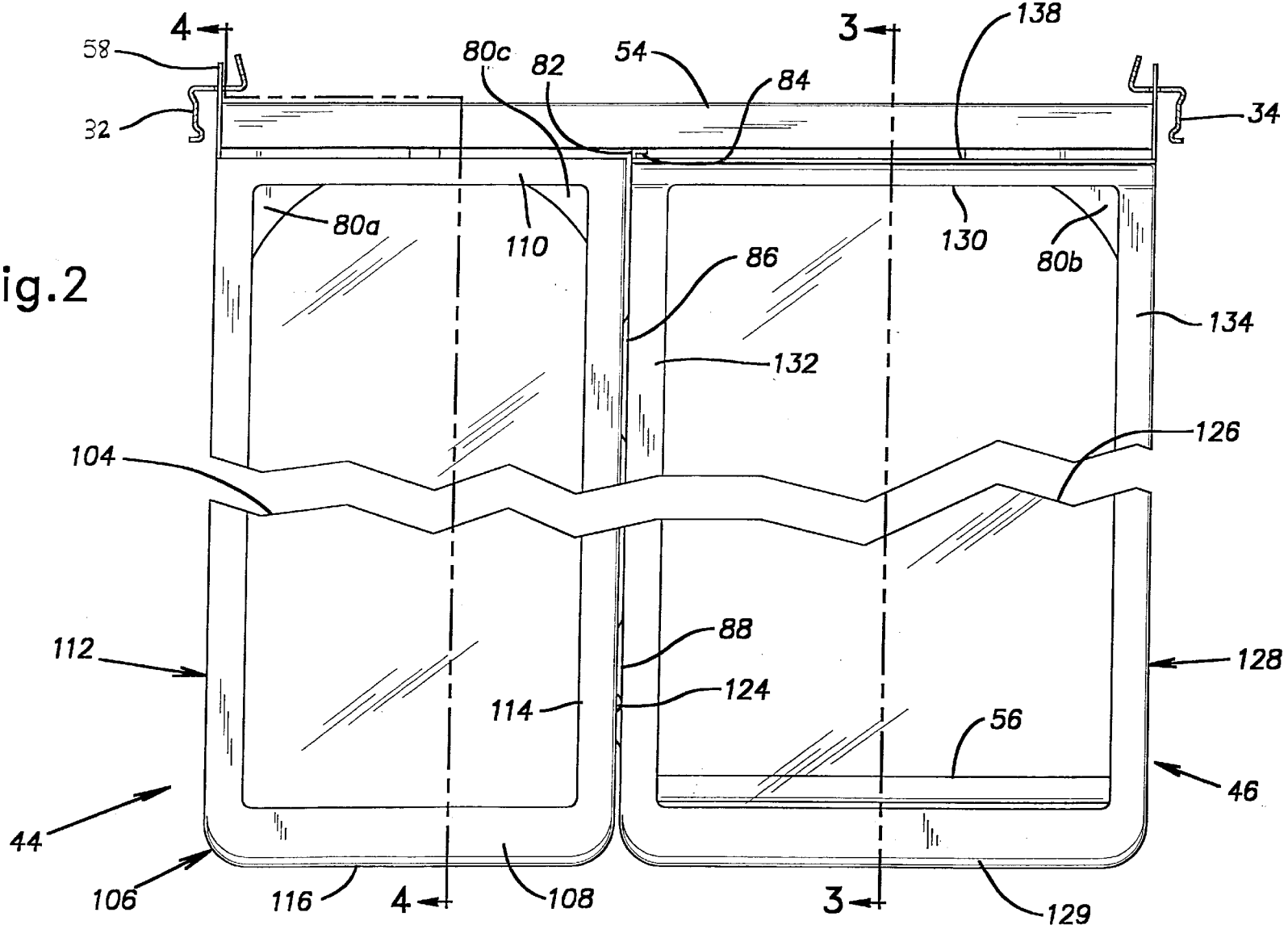
FIG. 2 is a top plan view of the shelf assembly shown in FIG. 1.

A rearwardly facing surface 148 of the front side 129 or handle portion 136 engages the distal ends 100, 102 of the central support bracket 52 and the second lateral support bracket 50 to limit insertion of the second shelf 46 into the support frame 42, and defines the "fully retracted" position of the second shelf 46 (FIGS. 2, 3).

The shelf assembly 22 of the present invention is assembled by first putting the support frame 42 together, and then mounting the first and second shelves 44, 46 thereon. With the support frame 42 assembled, the first shelf 44 is pivotally mounted to the first lateral support bracket 48 simply by inserting the rod 66 into the hinge members 70. More specifically, and as noted hereinbefore, pushing the terminal ends 119 of the hinge members' semi-cylindrical projections 118 toward the rod 66 causes the projections 118 to resiliently deform or elastically spread apart to admit the rod 66 between the projection's terminal ends 119. As the rod 66 passes the terminal ends 119, the semi-cylindrical projections 118 snap-back to their original position to retain the rod 66 thereunder.

The grooves 140, 142 of the second shelf 46 are aligned with the V-shaped projections 94, 78 of the central support bracket 52 and the second lateral support bracket 50, and the second shelf 46 is slidably inserted therebetween. When the angled rear surface of the stops 144 engages the cross brace 56, the second shelf 46 is cammed slightly upwardly, and snaps over the cross brace 56 to slidably secure the second shelf 46 between the central support bracket 52 and the second lateral support bracket 50.

The shelf assembly 22 according to the present invention is removably mounted to the first and second mounting rails 32, 34, via the hooks 60, 74, respectively provided on the first and second lateral support brackets 48, 50. The shelf assembly 22 may be relocated to numerous positions within the refrigeration compartment 30, as desired.

When a particularly tall item, such as a two-liter soda bottle, is to be stored within the refrigeration compartment 30, the first shelf 44 can be rotated to the first or second angled storage positions (FIGS. 7*a*, 7*b*, and 8) to permit the tall item to be placed on the next-lower shelf. It is noted that there is no structural support member extending between the distal ends of the first lateral support bracket 48 and the central support bracket 52, so no obstruction to placement of tall items relatively beneath the angled first shelf 44 is encountered.

The second shelf 46 is slidable from the retracted to the extended positions as may be necessary from time to time to inspect the contents of the second shelf. The second shelf 46 is at no risk of unintended removal, due to the engagement of the stops 144 with the cross brace 56.

While the preferred embodiment of the present invention is shown and described herein, it is to be understood that the same is not so limited but shall cover and include any and all modifications thereof which fall within the purview of the invention. For example, it is contemplated that the mounting of the first and second shelves 44, 46 could be reversed such that the first, pivotable shelf 44 is on the right hand side and the second, slidable shelf 46 is on the left-hand side. It is further contemplated that the support frame 42 could be modified such that the central support bracket 52 includes the rod 66 about which the first shelf 44 pivots and the first lateral support bracket 48 includes the tabs 120, 122 which support the first shelf 44 in a horizontal, deployed position. Also, the spacer member 124 member could be integrally formed with or otherwise provided by the central support bracket 52.

Furthermore, it is contemplated that the first shelf 44 could be replaced by two adjacent hinged shelves (i.e., a pivotal rear half shelf and a pivotal front half shelf). It is also contemplated that various other stops could be incorporated into the shelves 44, 46 and support frame 42 to control or limit movement of the shelves as desired, such as to support the pivotal shelf at various other angular positions and to help retain the slidable shelf at various degrees of extension.

It is noted that although the shelf assembly 22 is described herein in conjunction with a side-by-side refrigerator 20, it is contemplated, and considered apparent, that the shelf assembly 22 according to the present invention would be equally functional in a top mount refrigerator, and could be formed as either a full-width shelf assembly or a partial-width shelf assembly.

Furthermore, it is contemplated that the slidable shelf 46 could be replaced by a fixed shelf, and that the second lateral support bracket 50 and central support bracket 52, or like structures, could be integrally formed with, or molded into, the rim of such a fixed shelf. For example, the fixed shelf, the second lateral support bracket, central support bracket and the cross brace, or like structures, could be formed as a subassembly to facilitate assembly of such a modified shelf assembly.

Moreover, it is noted that, although the shelves 44, 46 in the illustrated and preferred embodiment have a rim which is integrally molded over the shelf plate, it is contemplated that the shelf plate and rim could be formed by various other means. For example, the shelf plate, instead of being a continuous, transparent plate, could be wire, as is common for refrigerator shelves. Alternatively, the rim could be snap-fitted to the shelf plate.

It is also contemplated, though not preferred, that on a modified version of the present invention having a fixed (i.e., not slidable) second shelf, the central support bracket and second lateral support bracket could be integrally molded with, or otherwise attached to, the rim of the second shelf.

Therefore, the present invention is not limited merely to the preferred embodiment illustrated and described herein, but shall include numerous other assemblies that fall within the scope and spirit of the present invention, as defined by the claims appended hereto.

What is claimed:

1. A refrigerator shelf support assembly, comprising:

first and second mounting rails;

first and second lateral support brackets, said first lateral support bracket having a proximal end removably secured to the first mounting rail, said second lateral support bracket having a proximal end removably secured to the second mounting rail;

a support member having a first terminal end attached to said first lateral support bracket and an opposite, second terminal end attached to said second lateral support bracket;

a central support bracket having a proximal end attached to said support member intermediate said first and second lateral support brackets and extending outwardly from said support member, wherein said central support bracket cooperates with said first and second lateral support brackets to define a support frame adapted to movably support a plurality of shelves in a side-by-side manner.

2. A refrigerator shelf support assembly according to claim 1, further comprising a cross brace, said cross brace having a first terminal end attached to the central support bracket and a second terminal end attached to the second lateral support bracket.

3. A refrigerator shelf assembly according to claim 2, wherein said central support bracket and said second lateral support bracket cooperate to define a support for a slidable shelf.

4. A refrigerator shelf support assembly according to claim 1, wherein said first lateral support bracket pivotally supports a shelf.

5. A refrigerator shelf support assembly according to claim 1, wherein said central support bracket and said first lateral support bracket cooperate to define a support for a pivotable shelf.

6. A refrigerator shelf support assembly according to claim 5, further comprising a cross brace, said cross brace having a first terminal end attached to the central support bracket and a second terminal end attached to the second lateral support bracket.

7. A refrigerator shelf support assembly according to claim 6, where in s aid central support bracket and said second lateral support bracket cooperate to define a support for a slidable shelf.

8. A refrigerator shelf support assembly according to claim 1, wherein said lateral support brackets extend in a cantilever fashion from the mounting rails and the central support bracket extends in a cantilever fashion from the support member.

9. A refrigerator shelf support assembly according to claim 1, further comprising a first gusset, said first gusset being attached to said first lateral support bracket and said support member and serving to stiffen said first lateral support bracket.

10. A refrigerator shelf support assembly according to claim 9, further comprising second and third gussets, said second gusset being attached to said second lateral support bracket and said support member and serving to stiffen said second lateral support bracket, said third gusset being attached to said central support bracket and said support member and serving to stiffen said central support bracket.

11. A shelf assembly for a refrigerator, comprising:

first and second mounting rails;

first and second lateral support brackets, said first lateral support bracket having a proximal end removably secured to the first mounting rail, said second lateral support bracket having a proximal end removably secured to the second mounting rail;

a support member having a first end attached to said first lateral support bracket and an opposite, second end attached to said second lateral support bracket;

a central support bracket attached to said support member intermediate said first and second lateral support brackets and extending outwardly from said support member generally parallel to said lateral support brackets;

a first shelf pivotally mounted to one of said first lateral support bracket or said central support bracket; and, a second shelf movably mounted to said second lateral support bracket and said central support bracket, said first and second shelves being side-by-side and laterally spaced from one another.

12. A shelf assembly according to claim 11, further comprising a cross brace, said cross brace having a first end rigidly attached to the central support bracket and a second end rigidly attached to the second lateral support bracket.

13. A shelf assembly according to claim 12, wherein said second shelf includes a stop, said stop engaging one of said support brackets or said cross brace to limit sliding movement of said second shelf.

14. A shelf assembly according to claim 11, wherein said second shelf is slidably movable between a retracted, normal position and an extended position.

15. A shelf assembly according to claim 11, wherein said first shelf is pivotally movable between a generally horizontal deployed position and an angled storage position.

16. A shelf assembly according to claim 15, wherein said first shelf is pivotally mounted to said first lateral support bracket, and said central support bracket cooperates with said first lateral support bracket to support said first shelf when said first shelf is in said deployed position.

17. A shelf assembly according to claim 15, wherein said first shelf is pivotally mounted to said first lateral support bracket and includes a member which is operable to engage said first lateral support bracket and retain said first shelf in said angled storage position.

18. A shelf assembly according to claim 17, wherein said member is a detent which engages an upper edge of said first lateral support bracket.

19. A shelf assembly according to claim 11, wherein said first shelf is pivotally movable between a generally horizontal deployed position, a first angled storage position, and a second angled storage position.

20. A shelf assembly according to claim 19, wherein said first shelf includes a first member which is operable to retain said first shelf in said first angled storage position.

21. A shelf assembly according to claim 20, wherein said first shelf includes a second member which is operable to retain said first shelf in said second angled storage position.

22. A shelf assembly according to claim 21, wherein said first shelf is pivotally mounted to said first lateral support bracket, and said first and second members are detents which are operable to maintain said first shelf in said first and second angled storage positions, respectively, by engaging said first lateral support bracket.

23. A shelf assembly according to claim 11, wherein said lateral support brackets extend in a cantilever fashion from the mounting rails and the central support bracket extends in a cantilever fashion from the support member.

24. A shelf assembly according to claim 11, wherein said first and second shelves comprise shelf plates surrounded by a rim, the rim forming a barrier along the periphery of the shelf plate to prevent liquids spilled onto the shelf plate from flowing off the shelf plate.

25. A refrigerator, comprising:

an insulated cabinet including a plurality of walls;

a door pivotally mounted to said cabinet and cooperating with said plurality of walls to define a compartment;

first and second mounting rails disposed within said compartment and secured to one of said plurality of walls, said mounting rails being spaced a predetermined distance from one another;

first and second lateral support brackets, said first lateral support bracket having a proximal end removably secured to the first mounting rail, said second lateral support bracket having a proximal end removably secured to the second mounting rail;

a support member having a first end attached to said first lateral support bracket and an opposite, second end attached to said second lateral support bracket;

a central support bracket attached to said support member intermediate said first and second lateral support brackets and extending outwardly from said support member, wherein said central support bracket cooperates with said first and second lateral support brackets to define a support frame;

a first shelf disposed upon and supported by said support frame; and, a second shelf disposed upon and supported by said support frame, said second shelf being laterally spaced from said first shelf, and wherein said first and second shelves are supported by said support frame in a side-by-side fashion.

26. A refrigerator according to claims 25, further comprising a cross brace, said cross brace having a first end attached to the central support bracket and a second end attached to the second lateral support bracket.

27. A refrigerator according to claim 26, wherein said second shelf is slidably movable between a retracted position and an extended position.

28. A refrigerator according to claim 27, wherein said second shelf includes a stop, said stop engaging one of said support brackets or said cross brace to limit sliding movement of said second shelf.

29. A refrigerator according to claim 25, wherein said first shelf is pivotally mounted to said first lateral support bracket and said second shelf is slidably mounted between said central support bracket and second lateral support bracket.

30. A refrigerator according to claim 25, wherein said first and second lateral support brackets extend in a cantilever fashion from the mounting rails and the central support bracket extends in a cantilever fashion from the support member.

31. A refrigerator according to claim 25, wherein said first shelf is pivotally movable between a generally horizontal deployed position and an angled storage position.

32. A refrigerator according to claim 31, wherein said central support bracket cooperates with said first lateral support bracket to vertically support said first shelf when said first shelf is in said deployed position.

33. A shelf assembly for a refrigerator, comprising:

first and second mounting rails;

a first pivotally movable shelf;

a support member having first and second ends;

a first lateral support bracket having a proximal end removably secured to said first mounting rail and secured to said first end of said support member; and, a subassembly, comprising:

a second lateral support bracket, a central support bracket, and a second shelf, said second lateral support bracket having a proximal end removably secured to said second mounting rail and secured to said second end of said support member, said central support bracket having a proximal end secured to said support member intermediate said first and second ends of said support member, said second shelf being slidably mounted to said second lateral support bracket and said central support bracket;

wherein said first shelf is pivotally movable between a generally horizontal deployed position and an angled storage position, said central support bracket and said first lateral support bracket cooperating to support said first shelf in said horizontal deployed position.

34. A shelf assembly according to claim 33, wherein said first shelf is pivotally mounted to said first lateral support bracket.

35. A shelf assembly for a refrigerator, comprising:

a support frame; and, a shelf, said shelf comprising:

a generally planar shelf plate defining a support surface for an article to be stored; and, a rim surrounding said shelf plate, said rim comprising a first lateral side including a hinge member and a detent member and a second lateral side located on an opposite side of said shelf plate relative to said first lateral side and including a spacer member, said spacer member serving to position said shelf relative to said support frame;

wherein said hinge member is pivotally secured to said support frame and said detent member releasably engages said support frame and is operable to releasably retain said shelf in an angled storage position.

36. A shelf assembly as recited in claim 35, wherein said detent member includes a plurality of detent ribs, each of said ribs being operable to releasably engage said support frame to thereby releasably retain said shelf in an associated angled storage position.

* * * * *